United States Patent [19]

Kahlow et al.

[11] 4,157,654

[45] Jun. 12, 1979

[54] TUBE FORMING PROCESS

[75] Inventors: Kurt J. Kahlow, North Canton; Richard L. Holbrook, Louisville, both of Ohio

[73] Assignee: The Babcock & Wilcox Company, New York, N.Y.

[21] Appl. No.: 866,733

[22] Filed: Jan. 3, 1978

[51] Int. Cl.[2] ..... B21D 11/00; B21C 3/00

[52] U.S. Cl. ..... 72/367; 72/166; 72/167; 72/369; 72/467

[58] Field of Search ..... 72/467, 167, 166, 283, 72/367, 369, 468

[56] References Cited

U.S. PATENT DOCUMENTS

| | | | |
|---|---|---|---|
| 1,943,700 | 1/1934 | Snell | 72/167 |
| 2,976,908 | 3/1961 | Ferguson | 72/167 |
| 3,095,083 | 6/1963 | Helble et al. | 72/467 X |
| 3,293,897 | 12/1966 | Holter | 72/166 X |
| 3,354,681 | 11/1967 | Lombard | 72/467 X |

*Primary Examiner*—Milton S. Mehr

*Attorney, Agent, or Firm*—J. M. Maguire; R. C. Mai

[57] ABSTRACT

A method of forming a tube by pushing it through a tilted die to form a bend or change circumferential variations in wall thickness.

3 Claims, 4 Drawing Figures

TUBE FORMING PROCESS

BACKGROUND OF THE INVENTION

This invention relates to the manufacture of tubular sections of ductile materials and, more particularly, to a novel method of forming bends or of changing wall eccentricity by pushing the tubular section through a tilted die causing a greater diameter reduction on one portion of the tube circumference than on the opposite portion.

Numerous bending processes have been developed over the years, but generally speaking, most such methods are variations of a few basic processes. No single process can be successfully applied to all bending situations where variations of tubular section size, diameter-to-wall thickness ratio, material or angle of bend are considered. For instance, the press method, wherein the tube is laid across a plurality of wiper dies and then subjected to the pressure exerted by a form die, is useful when some flattening of the tubing can be permitted. The roll method of bending employs three or more triangularly arranged rolls, the center one of which is adjustable. The workpiece is fed between the fixed driven rolls and the adjustable roll to form the bend. The draw method bends the tube by clamping it against a rotating form and drawing it through a pressure die. In all of these methods, thinning of the tube wall, especially on the extrados, and loss of section circularity occur. The thinner the tube wall and/or the tighter the bend sections, the more severe these problems become.

In attempting to eliminate loss of cross section circularity, the use of various types of mandrels or other means of internal support has been employed with varying degrees of success. In some instances, the use of internal tools has led to process complications or given birth to new problems such as scarring of the inner wall or non-uniform wall thinning.

U.S. Pat. No. 3,354,681 discloses a method and apparatus for bend-forming elbows from tubular sections by pushing through a forming die. A portion of this apparatus consists of a "tapered land" which the inventor claims to cause bending by differential friction, the friction force being greater on the inside radius of the bent tubular section than on the outside radius, which is in direct contradiction to the findings of our invention.

Another problem pervasive in the tubing industry is that of tube wall eccentricity. Eccentricity may be loosely defined as the distance between the center of the tube cross section with respect to its inner diameter and the center with respect to its outer diameter. When such centers do not coincide, the member is eccentric. Eccentricity correction is concerned with reducing differences in wall thickness. U.S. Pat. No. 3,095,083 discloses a method and apparatus for correcting eccentricity by drawing (pulling) the member through a tilted die without the use of internal tools. However, not only is the amount of eccentricity correction obtainable limited but it has been found that the die will in some instances produce wall thickening and in other instances produce wall thinning. This same technique to effect eccentricity correction is employed in U.S. Pat. No. 3,131,803 wherein the tilted die is used in combination with an internal mandrel. Other approaches to eccentricity correction are also employed, for example: U.S. Pat. No. 3,167,176 uses a swivel mandrel, and U.S. Pat. No. 3,698,229 uses metal removal from the heavy wall portion of the tube.

SUMMARY OF THE INVENTION

The present process to a large extent overcomes many of the attendant problems of the prior art processes relating to tube bending and eccentricity correction. In that aspect of the present invention directed at bending, a tube of ductile material is pushed through a tilted die defined by certain angular relationships with respect to the longitudinal axis of the tube. As used in this disclosure, a tilted die is a die having bilateral symmetry about the incoming tube axis i.e., a unique plane of symmetry contains the straight incoming tube axis. When pushed through such a die, the tubular member is subjected to differential swaging and to a displacement of forces acting normal to the tube axis, thus causing the tube to bend. Unlike prior art practices, the tube experiences wall thickening completely around the circumference.

A second aspect of the present invention involves pushing the tubular member through a tilted die to bring about eccentricity correction by proper orientation of the originally eccentric tube with respect to the tilt angle of the die.

The application of a tilted die in a composite die for forming tubular fittings is disclosed in co-pending application Ser. No. 866,735 filed Jan. 3, 1978.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which a preferred embodiment of the invention is illustrated and described.

DESCRIPTION OF THE PREFERRED EMBODIMENT

The present invention is generally directed at a process for selectively changing various dimensional aspects of already formed tubular members to produce high quality bends, or to correct undesirable eccentricity characteristics, or to create desirable eccentricity characteristics. The invention is applicable to tubular members which are constructed of flowable (ductile) materials such as ferrous and non-ferrous metals as well as plastics and related flowable materials.

I TUBE BENDING

Figure 1:
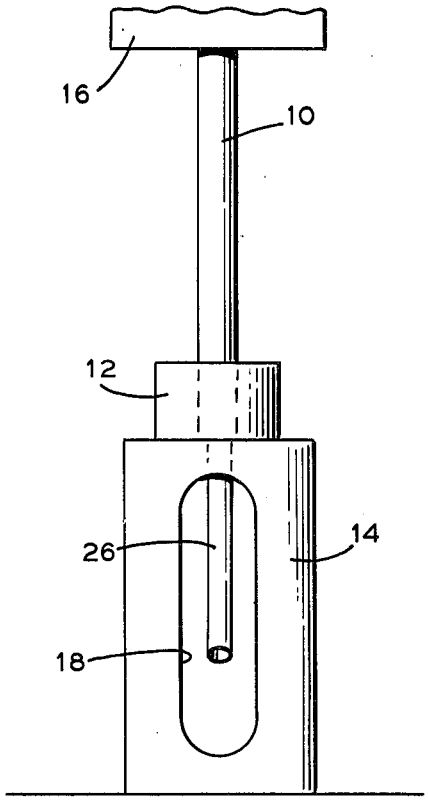
FIG. 1 generally depicts a suitable arrangement employed for carrying out the forming process.

Referring to FIG. 1, tubular member 10, the outside surface of which may be treated with a commercial lubricant, is operatively positioned at the entrance section of tilted die 12. An introductory guidance section (not shown) may be desirable. Die 12 rests on or is firmly attached to support fixture 14. Press platen 16 separately contacts or, in some manner, fixes with the free end of the tubular member 10 and pushes the member into and through die 12. The tube does not necessarily have to be pushed on its end, for example, it can be pushed with grips which clamp the tube ahead of the die entrance. The pushing force can be provided by a press or any other pushing device. Fixture 14 supports the forming die 12 and provides an exit path for the formed tubular member 26 through opening 18.

Figure 2:
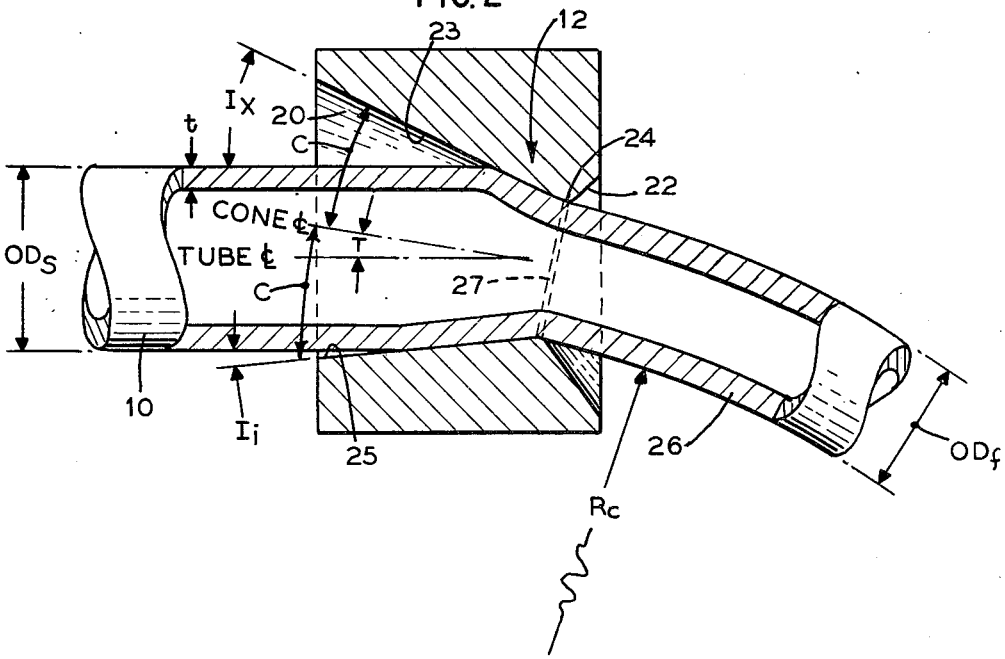
FIG. 2 shows a cutaway view of the tubular member being forced through the tilted die of FIG. 1.

Referring to FIG. 2, the combination of the tilted die 12 with tubular member 10 having been pushed therein is characterized by certain geometric considerations related thereto. Member 10 starts with an original outside diameter $OD_s$. (Note, for convenience of illustration, FIG. 2 shows a particular form of a bilaterally symmetric die (or tilted die) composed of circular conical sections.) For purposes of further explanation, it is helpful to locate the centerline (℄) of the entering tube 10 as it enters the die 12. Tilted die 12 may be thought of as a shape fashioned from an entrance cone 20 and a relief cone 22. Cone 20 is a first truncated hollowed conical section, and cone 22 is a second truncated hollowed conical section. Note that these sections need not necessarily be circular cones, although for most practical processes circular cones would be used. The conical sections 20 and 22 meet at the plane of truncation commonly called a land or throat 24 such that when the unbent tubular member 10 is forced through cone 20, it passes land 24 as a bent tube 26 into section 22. Tubular member 10, which started with an original outside diameter $OD_s$ is deformed by passage through the die to a formed tubular member 26 exhibiting an outer diameter $OD_f$. The entrance cone 20 may be further described with respect to the starting member 10 and the formed member 26 by reference to the following symbols:

C=the die cone angle (often called the semi-cone angle) which is the angular relationship between the surface of the cone and the centerline of the cone.

T=die tilt angle which is the angular relationship between the die or cone centerline and the entering tube centerline.

$I_x$=maximum die inlet angle, equal to C+T.

$I_i$=minimum die inlet angle, equal to C−T.

$R_c$=inner radius of curvature of the bent tube.

Shown in FIG. 2 is a tilted die whose die exit plane 27 is normal to the die or cone centerline. Although this is desirable for most practical processes, this exit plane 27 need not necessarily be normal to the die centerline. Instead, the exit plane 27 could be canted to either side of this normal orientation, and tube bending would still result.

It will be observed that $I_x$ and $I_i$ define oppositely located steep and shallow sections, respectively, of the entrance cone 20 with respect to the centerline of member 10. As member 10 is pushed through die 12, one portion of its circumference, which encounters the steepest portion of the die experiences a larger swage (diameter reduction) than the opposite portion, the largest swage and accompanying swaging force occurring at that portion of the cone associated with the maximum inlet angle $I_x$. Well-established metal forming principles dictate the maximum practical angles which can be utilized without causing excessive "redundant work" that creates high pushing forces which in turn promote tube buckling or irregular bending. We have found that $I_x$ has a critical upper limit of about 40°, and the tilt angle has a critical upper limit of 20° and should be greater than 0° and equal to or less than the cone angle. The critical limit of $I_x$ varies somewhat depending upon the $OD_s/t$ ratio (wherein t is the thickness of the original tube wall), upon the diameter reduction, and frictional characteristics. When these limits are exceeded, the entering tubing will tend to buckle or the member exiting the die will have unpredictable irregular bending and a non-uniform radius of curvature. These limits define a transition zone and, when not exceeded, result in predictable, uniform bending of the tubing having a uniform radius of curvature. Beyond this transition zone, the member exiting the die exhibits unpredictable behavior with a surprising decrease in bending and an erratic radius of curvature.

The differential swaging results in material flow proportional thereto causing greater elongation at that portion of the tubular member experiencing the larger swage, the differential elongation resulting in bending. It will be noted that during pushing of the tubular member 10 through die 12, a portion of the member's circumference closest to the $I_i$ element 25 of the entrance cone contacts the die prior to the opposed portion contacting the $I_x$ element 23 of the cone. This offset of initial contact in the entrance zone 20 results in an offset of die forces normal to the tube 10, thus producing a couple (or moment) which in turn promotes further tube bending. It should be noted that, even in the extreme case of no diameter reduction (that is, when the tube $OD_s$ equals the diameter of the die throat 24), a tube which is pushed through a tilted die will experience this offset of die forces and thus will bend; this phenomenon can be proven geometrically. Some finite amount of permanent bending will occur so long as the tilt angle is large enough to cause some finite amount of plastic deformation of the tube.

It has also been found that the above approach results in the overall tubular cross section remaining substantially round, and generally in wall thickening around the entire cross section. When properly practiced, the process virtually eliminates the possibility of tube wall collapse which has hampered so many prior art bending processes, but does so without requiring use of a mandrel or other types of internal support. The inventive process also displays an extremely desirable range of application with respect to $OD_s/t$ ratios in comparison with those prior art processes without internal support mechanisms, with slight variations with respect to the particular material. Bends well beyond 180° can be routinely made, the limitation being only bent tube clearance of the equipment. The process is applicable to any malleable or ductile material. By providing support to either the outside or the inside surface of the straight tube 10, buckling could be retarded. By performing the entire process under a sufficiently high environmental hydrostatic pressure (e.g., in a high pressure chamber), normally brittle (difficult-to-deform without fracture) materials could be bent. The tube can be formed cold, warm, or hot.

The following Table 1 summarizes test results obtained in the bending of particular carbon steel tubing experiencing a 5.3% reduction of outer diameter.

TABLE I

BENDING OF 1.130" $OD_s$ CARBON STEEL TUBES. 5.3% OD REDUCTION

| STARTING TUBE | | | FORMED TUBE | | | | | | |
|---|---|---|---|---|---|---|---|---|---|
| OUTSIDE DIAMETER ($OD_s$) | WALL THICKNESS (t) | DIAMETER TO-THICKNESS RATIO ($OD_s$/t) | WALL THICKNESS INCREASE INNER RADIUS | WALL THICKNESS INCREASE OUTER RADIUS | OD OUT-OF-ROUNDNESS | INNER RADIUS OF CURVATURE ($R_c$) | DIE CONE ANGLE (C) | DIE TILT ANGLE (T) | REQUIRED PUSHING FORCE |
| 1.130" | .085" | 13.3 | 4.6% | 4.7% | .002" | 57.1" | 8° | 3° | 2300-2600# |
| " | " | " | 4.6 | 4.7 | .004 | 39.3 | 20 | 6 | 3000 |
| " | " | " | 5.9 | 5.8 | .002 | 32.3 | 15 | 6 | 3400-3500 |
| " | " | " | 3.3 | 5.6 | .004 | 22.1 | 8 | 6 | 3000-3100 |
| " | " | " | 7.0 | 8.2 | .019 | 18.54 | 28 | 12 | 3700 |
| " | " | " | 7.1 | 7.0 | .013 | 16.1 | 20 | 12 | 3500 |
| " | " | " | 2.3 | 8.2 | .013 | 13.6 | 15 | 12 | 3600-3800 |
| " | " | " | 7.0 | 19.8 | .029 | 22.2 | 28 | 18 | 6700 |
| " | " | " | 3.5 | 9.2 | .026 | 10.5 | 20 | 18 | 4100-4200 |
| " | " | " | 3.5 | 19.5 | .034 | 24.8 | 22 | 20 | 6900-9000 |
| " | " | " | 5.8 | 19.5 | .039 | 22.7 | 24 | 22 | 7000-7800 |
| " | .116 | 9.7 | 4.2 | 3.4 | .003 | 54.4 | 8 | 3 | 2900-3200 |
| " | " | " | 4.3 | 3.4 | .003 | 37.0 | 20 | 6 | 3600-3700 |
| " | " | " | 5.2 | 5.1 | .003 | 25.6 | 15 | 6 | 4300-4500 |
| " | " | " | 3.4 | 4.2 | .002 | 21.7 | 8 | 6 | 3600-3900 |
| " | " | " | 6.0 | 6.0 | .015 | 16.0 | 28 | 12 | 5200 |
| " | " | " | 6.0% | 5.1% | .012" | 13.2" | 20° | 12° | 4500-4600# |
| " | " | " | 3.4 | 5.9 | .009 | 11.7 | 15 | 12 | 4100-4300 |
| " | " | " | 8.5 | 20.3 | .031 | 47.7 | 28 | 18 | 10200 |
| " | " | " | 5.1 | 8.6 | .025 | 9.2 | 20 | 18 | 5400-5500 |
| " | " | " | 4.2 | 20.5 | .040 | 27.7 | 22 | 20 | 9500-10500 |
| " | " | " | 5.0 | 21.8 | .044 | 30.3 | 24 | 22 | 10300-12700 |
| " | .144 | 7.8 | 4.2 | 2.7 | .002 | 45.6 | 8 | 3 | 3200-3400 |
| " | " | " | 3.5 | 2.7 | .004 | 28.1 | 20 | 6 | 4400-4600 |
| " | " | " | 4.8 | 4.9 | .002 | 21.4 | 15 | 6 | 4800-5300 |
| " | " | " | 3.4 | 4.2 | .002 | 19.1 | 8 | 6 | 3800-4100 |
| " | " | " | 6.2 | 6.0 | .016 | 12.8 | 28 | 12 | 6300-6600 |
| " | " | " | 6.9 | 4.1 | .016 | 10.8 | 20 | 12 | 5100-5300 |
| " | " | " | 3.4 | 4.8 | .012 | 10.2 | 15 | 12 | 4700-5000 |
| " | " | " | | Tube Buckled | | | 28 | 18 | — |
| " | " | " | 4.8 | 7.5 | .031 | 8.1 | 20 | 18 | 6700-6800 |
| " | " | " | 4.1 | 16.9 | .032 | 35.3 | 22 | 20 | 13000-13800 |
| " | " | " | | Tube Bent Irregularly | | | 24 | 22 | 19000-21300 |

As a result of a comprehensive analysis of many tests we have discovered that the radius of curvature of the bent tubing is strongly influenced by the tilt angle and to a lesser degree by the outside diameter reduction and the original diameter-to-thickness ratio. The required pushing force on the tubing within the die is a strong function of the outside diameter reduction and a weak function of the tilt angle, the cone angle, and the original diameter-to-thickness ratio. We have also found that maximum bending occurs when the tilt angle approaches 18° and the cone angle is a minimum in excess of the tilt angle, in the order of 0° to 2°. The test results further indicate that maximum bending occurs when the percent reduction of outside diameter of the tubing is equal to approximately one-half the value of the original diameter-to-thickness ratio.

II TUBE ECCENTRICITY CORRECTION

The pushing of a tubular member through tilted die 12 sets up forces resulting in material flow proportional to the swaging angle that the particular portion of the tube "sees". In all cases, pushing the member 10 through die 12 results in increased wall thickness completely around the circumference. The maximum thickness increase occurs at that portion of the tube seeing the maximum swage (at $I_x$), and the minimum thickness increase corresponds to the minimum swage (at $I_i$).

Figure 3:
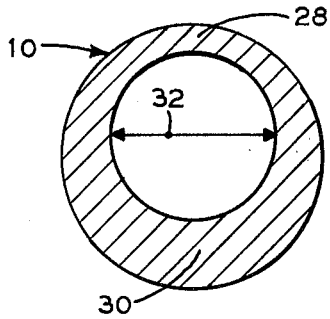
FIG. 3 shows a cross section of a tubular member before being subjected to the eccentricity correction procedure.

FIG. 3 shows a cross sectional view of tubular member 10 (with a minimum wall thickness 28, a maximum wall thickness 30, and an inside diameter 32) prior to its entry into tilted die 12. Eccentricity is shown in exaggerated form for easier viewing.

Tubular member 10 is pushed through die 12 in accordance with the procedure heretofore described. However, when the process is being used for eccentricity correction purposes, the member's orientation is quite important. Since pushing the member through the die always results in wall thickening about the member's circumference, the minimum wall thickness 28 should "see" the maximum swage portion 20 of the die. The maximum swage angle can be selected based on the amount of eccentricity correction required. Of course, bending accompanies the eccentricity correction, and the tube may require a straightening operation depending on the application requirements.

Figure 4:
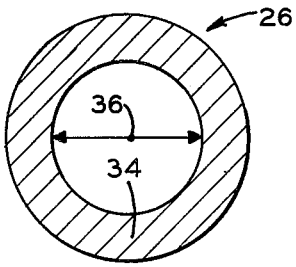
FIG. 4 shows the tube cross section after having undergone the eccentricity correction procedure.

FIG. 4 shows the cross section of member 26 after exiting relief cone 22 of die 12. The member is shown as having a wall 34 uniform in cross section about the member's circumference, an inside diameter 36 reduced from original inside diameter 32, and an outside diameter $OD_f$ reduced from original outside diameter $OD_s$.

Table II compares the change in percent eccentricity (after straightening) obtainable by the present process as compared to the prior art method of drawing the tube through the die. As is readily apparent, a significant increase in the change in percent eccentricity characterizes the present inventive method.

In some instances it may be desired to change but not necessarily to correct the eccentricity. In these cases the entering tube is properly oriented with respect to the die to effect the desired change in wall thickness about the tube circumference in accordance with the principles previously described.

TABLE II.

Eccentricity Correction Of Carbon Steel Tubes

| Tile Angle (T) | Cone Angle (C) | Diameter-To-Thickness Ratio ($OD_s/t$) | Initial Eccentricity ($E_f\%$)* | Change In Percent Eccentricity ($\Delta$ E%)** | |
|---|---|---|---|---|---|
| | | | | Present Process | Prior Art |
| 6° | 8° | 10.5 | 3.15% | 4.09% | 2.4% |
| 12° | 15° | 10.5 | 3.87% | 6.43% | 4.3% |
| 12° | 15° | 14.7 | 4.34% | 7.09% | 5.1% |

$$*E_f\% = \frac{t_{max} - t_{min}}{t_{max} + t_{min}} \times 100$$

where $t_{max}$ and $t_{min}$ are the maximum and minimum wal thicknesses, respectively.
**Absolute value of the percent change rom the initial condition.

The embodiments of the invention in which an exclusive property or privilege is claimed are defined as follows:

1. A method of bending tubing in a die having a truncated cone shaped passage terminating in a throat, formed with a steep section and a shallow section directly opposite the steep section, and proportioned and arranged so that the maximum die inlet angle $I_x$ is no greater than about 40° and the die tilt angle T is no greater than about 20° and greater than 0° and less than the cone angle C, where $I_x$ is equal to C+T, T is the angle between the die centerline and the entering tubing centerline, C is the angle between the surface of the cone and the die centerline, the method comprising pushing the tubing through the die passage to subject it to circumferential swaging forces within the die, causing the tube to be reduced in outside diameter, varying from a maximum where it encounters the steepest section and to subject it to an offset of die forces producing a couple or force moment, to a minimum where it encounters the shallow section to cause bending of the tubing about the shallow section, and allowing the tubing to bend without restraint beyond the throat.

2. A method of bending tubing as in claim 1 wherein the die has a tilt angle of 18° and a cone angle of 18° to 20° for maximum bending of the tubing.

3. A method as in claim 1 wherein the entire wall section of the tube increases in thickness in passing through the die.

* * * * *